US011361743B2

(12) United States Patent
Abraham et al.

(10) Patent No.: US 11,361,743 B2
(45) Date of Patent: Jun. 14, 2022

(54) MEGAPHONE HAVING ADDITIONAL LIGHTING OR AUDIBLE FEATURES

(71) Applicants: John J. Abraham, Newport Beach, CA (US); Sofia Ann Abraham, Newport Beach, CA (US)

(72) Inventors: John J. Abraham, Newport Beach, CA (US); Sofia Ann Abraham, Newport Beach, CA (US)

(73) Assignee: John J. Abraham, Newport Beach, CA (US)

( * ) Notice: Subject to any disclaimer, the term of this patent is extended or adjusted under 35 U.S.C. 154(b) by 319 days.

(21) Appl. No.: 16/352,682

(22) Filed: Mar. 13, 2019

(65) Prior Publication Data

US 2019/0287508 A1 Sep. 19, 2019

Related U.S. Application Data

(60) Provisional application No. 62/642,236, filed on Mar. 13, 2018.

(51) Int. Cl.

| | |
|---|---|
| ***G10K 11/08*** | (2006.01) |
| ***F21V 33/00*** | (2006.01) |
| ***F21Y 115/10*** | (2016.01) |

(52) U.S. Cl.

CPC ..... *G10K 11/08* (2013.01); *F21V 33/0056* (2013.01); *F21Y 2115/10* (2016.08)

(58) Field of Classification Search

CPC ..... G10K 3/00

See application file for complete search history.

(56) References Cited

U.S. PATENT DOCUMENTS

| | | | | |
|---|---|---|---|---|
| 5,859,915 | A * | 1/1999 | Norris | F41H 13/0081 381/75 |
| 2003/0063754 | A1* | 4/2003 | Mears | H04R 27/00 381/75 |
| 2005/0059501 | A1* | 3/2005 | Ballin | A63G 31/00 472/106 |
| 2005/0078470 | A1* | 4/2005 | Yang | F21V 33/0064 362/86 |
| 2009/0003619 | A1* | 1/2009 | Solow | H04S 7/30 381/77 |

(Continued)

*Primary Examiner* — Alexander K Garlen
*Assistant Examiner* — Eric T Eide
(74) *Attorney, Agent, or Firm* — Buchalter, a Professional Corporation

(57) ABSTRACT

An audio projection device having additional features or elements connected therewith. One or more lights or other illuminating elements may be connected with the audio projection device. The one or more lights or other illuminating elements may be disposed so as to illuminate through a portion of the audio projection device. One or more audible or other moveable elements may be connected or contained within a portion of the audio projection device. The one or more audible or moveable elements may be beads, or other spherical or other shaped components (e.g., rigid components) that are configured to make a sound (e.g., rattle) and/or be visible when they make contact with one another and/or other portions of the audio projection device. The audio projection device may be fully or partially transparent such that the one or more audible or moveable elements are viewable through material(s) of the audio projection device.

6 Claims, 7 Drawing Sheets

(56) References Cited

U.S. PATENT DOCUMENTS

2009/0288909 A1* 11/2009 Slack ..... G10K 11/025
181/148
2010/0327766 A1* 12/2010 Recker ..... H02J 7/0029
315/291

* cited by examiner

MEGAPHONE HAVING ADDITIONAL LIGHTING OR AUDIBLE FEATURES

CROSS REFERENCE TO RELATED APPLICATIONS

This application claims the benefit of U.S. Provisional Patent Application Ser. No. 62/642,236, filed on Mar. 13, 2018, entitled "IMPROVED MEGAPHONE HAVING ADDITIONAL LIGHTING OR AUDIBLE FEATURES," which is hereby incorporated by reference in its entirety into this application.

BACKGROUND

1. Field of the Invention

The present invention relates to an apparatus, system, or method for audio projection, such as a megaphone, including lighting and/or additional audible elements.

2. Description of the Related Art

Conventional megaphones typically operate by allowing a user to speak or otherwise provide a sound to one end or portion of the megaphone, and amplify such sound out another end or portion of the megaphone. Conventional megaphones have seen popular use at entertainment venues, such as sporting events, concerts, or other social activities where a large number of people desire to hear certain individuals speak. Particularly at entertainment venues, users charged with entertaining guests (e.g., public speakers, cheerleaders, dance teams, etc.) would desirably have devices that can further grab the audience attention and/or provide the audience with entertaining displays of light, sound, etc. While a conventional megaphone may aid in amplifying particular audio to a larger audience, it does not conventionally provide additional means of entertainment for the audience. An ideal, improved audio projection device would be capable of audio amplification in addition to incorporating further features.

SUMMARY

The present invention relates to an apparatus, system, and/or method for providing audio projection, such as a megaphone, that has additional features or elements incorporated therewith. For example, one such feature may include one or more lights or illuminating elements arranged on or around at least a portion of the audio projection device. In another example, one such feature may include one or more moving elements, such as beads, spheres, or other components configured to "rattle" when shaken disposed on or within at least a portion of the audio projection device. The audio projection device may be configured to be customized by a user with particular lighting elements or patterns, logos or other graphics, and/or other audible components.

In one embodiment, an audio projection device may include a body configured to receive a sound at a first end of the body and project the sound at increased volume at a second end of the body, a handle connected with the body, a manipulatable element connected with the body and configured to be manipulated by a user, at least one illuminating element connected with the body, and at least one audible element disposed within at least a portion of the body.

In another embodiment, an audio projection device may include a base component configured to receive a sound, a projection component connected with the base component and configured to project the sound, the projection component having an outer surface and an inner surface thereby defining a space between the outer surface and the inner surface, and at least one audible element disposed within the space of the projection component.

In still another embodiment, an audio projection device may include a base component configured to receive a sound, a projection component connected with the base component and configured to project the sound, at least one element disposed within a cavity at least partially defined by the projection component, wherein the at least one element is configured to move within the cavity, a manipulatable element configured to be manipulated by a user, and at least one illuminating element configured to provide illumination towards the projection component.

DETAILED DESCRIPTION

The following detailed description illustrates by way of example, not by way of limitation, the principles of the invention. The detailed description of exemplary embodiments herein makes reference to the accompanying drawings and pictures, which show the exemplary embodiments by of illustration. While these exemplary embodiments are described in sufficient detail to enable those skilled in the art to practice the invention, it should be understood that other embodiments may be realized and that logical and/or mechanical changes may be made without departing from the spirit and scope of the invention. It should be understood that the drawings are diagrammatic and schematic representations of exemplary embodiments of the invention, and are not limiting of the present invention nor are they necessarily drawn to scale.

Thus, the detailed description herein is presented for purposes of illustration only and not of limitation. For example, the steps recited in any method or process descriptions may be executed in any order and are not limited to only the order presented. Moreover, any of the functions or steps may be outsourced to or performed by one or more third parties. Furthermore, any reference to singular includes plural embodiments, and any reference to more than one component may include a singular embodiment.

Figure 1:
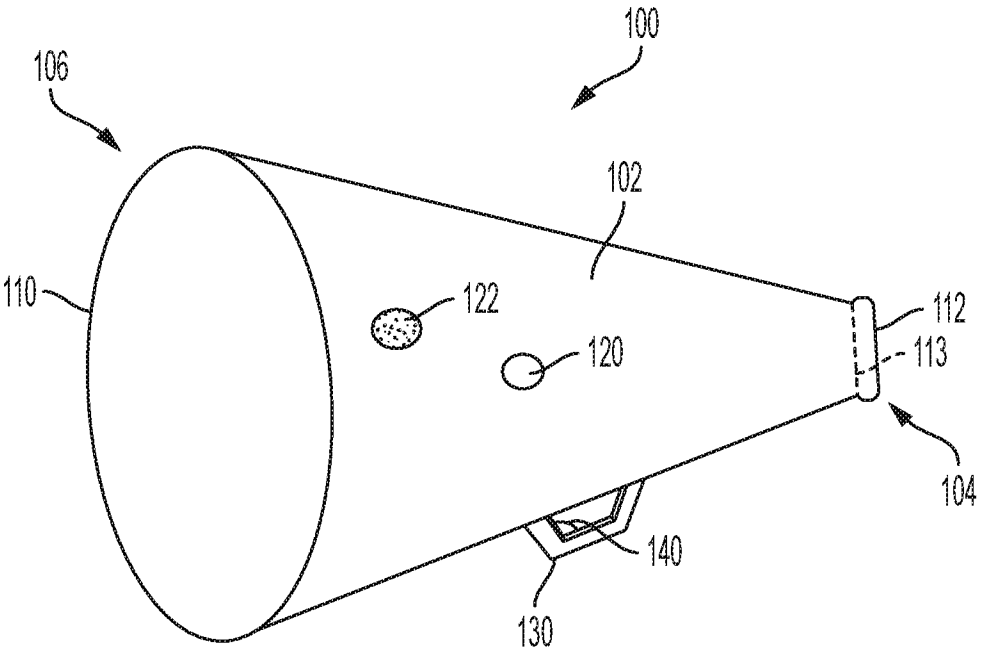
FIG. 1 illustrates a perspective view of an exemplary audio projection device having additional illumination and audible features, according to one embodiment of the present invention.

FIG. 1 illustrates an exemplary audio projection device 100. For example, in one embodiment, the audio projection device 100 may be a megaphone used for increasing the volume of a sound input to the audio projection device 100 (e.g., a voice or human speech spoken or otherwise provided into one end), and/or distance at which the sound may be projected. The audio projection device 100 includes certain elements or features for providing additional illumination and/or audible capabilities beyond just projection of the input sound, as discussed in greater detail herein.

The audio projection device 100 may include a body 102 (e.g., made of a transparent, translucent, semi-transparent, semi-translucent, opaque, or non-transparent material) that has a first end 104 (e.g., an input end configured to accept audio, noise, or sound) and a second end 106 (e.g., an output end configured to project or otherwise output the accepted audio, noise, or sound therefrom, such as at an increased volume). In one embodiment, sound may be configured to be output from any desired location of the audio projection device 100, such as from one or more of its sides and/or rear (e.g., using holes, slots, or other openings). Any of a variety of possible elements or structural components may be used for amplifying, projecting, or otherwise outputting sound, such as the use of one or more flexible materials (e.g., a diaphragm) that acts to amplify the sound waves transmitted through the audio projection device 100. In one embodiment and as illustrated in FIG. 1, the body 102 may be shaped substantially like a cone, having a size (e.g., diameter) at the second end 106 that is larger than a size (e.g., diameter) at the first end 104. In an alternative embodiment, any of a variety of possible shapes may be used, such as a triangle, pentagon, hexagon, octagon, or any other shape or design, etc. that may or may not have an outer perimeter that is greater at one end than an outer perimeter at another end (e.g., may or may not be reducing in size). In certain embodiments, the shape may change from one end to another (e.g., begin as a pentagon at one end, but transition to a circle at another end).

The first end 104 may include a sound receipt or input component, configuration, or end 112 (e.g., slots, microphone, etc.) connected or otherwise incorporated with one or more other elements or structural configuration for receiving audio from a source, such as a user, for transmission of such audio through the audio projection device 100. In one embodiment, the component, configuration, or end 112 may be configured to be removeable, modifiable, and/or replaceable 113 with respect to the body 102 and/or the first end 104, for example, to support the connection/disconnection of different components, configurations or ends as desired.

In one exemplary embodiment, for example, as discussed in greater detail herein, a ring or other layout of one or more lights (e.g., LEDs) may be configured to connect/disconnect (e.g., screw, snap, clip, bolt, rotate, adhere, etc.) at or near the first end 104 of the body 102 and/or at some location along the body 102. Different types, numbers, layouts, and/or configurations of lights, and/or other components, may be configured to connect/disconnect at the first end 104 of the body 102. Thus, a user may be able to purchase a structure of one or more lights of a particular type, number, layout, and/or configuration (e.g., having particular color(s), illumination characteristic or operation, such as a choice of a number (e.g., 1-8) of colors) or patterns of operation and connect/disconnect the structure of one or more lights with the first end 104 of the body 102 and/or otherwise at some portion along the body 102 as desired (e.g., corresponding to a particular team or event colors, etc.), for example as shown and discussed in greater detail herein.

In such an embodiment, a single audio projection device 100 may be modified for use with different teams or events that desire alternative color schemes or other operation by swapping out the structure of one or more lights or other components that make up and/or are incorporated with the audio projection device. In certain embodiments, as discussed in greater detail herein, operation (e.g., lighting patterns or animation) may be programmed and/or modified (e.g., downloaded, installed, and/or executed on one or more electrical components (e.g., memory, processors, controllers, etc.) to allow for lighting characteristics to be changed as desired.

In another exemplary embodiment, for example, as discussed in greater detail herein, the component, configuration, or end 112 may be a cap configured to connect/disconnect 113 (e.g., screw, snap, clip, bolt, rotate, adhere, etc.) at the first end 104 of the body 102. The cap may be removed by a user to allow access to an interior cavity or space of the body 102, such as an area for the placement of elements therein, such as one or more audible elements (120, 122) that may rattle or otherwise provide additional sound and/or entertainment as discussed in greater detail herein. In one embodiment, other features may be accessible or modifiable via the access to an inner cavity or space of the body 102, such as an inner tube, liner, sheet, or graphical depiction that can be inserted (e.g., disposed around the body 102 within the body 102 such that it can be viewed through the body 102). By securing the cap onto the first end 104 of the body 102, the elements placed therein may be contained within the cavity or space of the body 102 and thereby substantially prevented from exiting the cavity or space of the body 102 while the cap is secured with the body 102. In an alternative embodiment, the one or more audible elements (120, 122) may be disposed and/or contained within a portion of the body 102 in differing manners (e.g., without a removeable cap at and end of the body 104. In an alternative embodiment, the component, configuration, or end 112 may not be removeable and/or may incorporate elements integrated therein or thereon (e.g., lighting elements such as LEDs integrated into the component, configuration, or end 112, such as a mouthpiece of a megaphone).

A handle and/or other element 130 is connected with the body 102 and may be configured to allow a user to more easily and/or conveniently hold or maintain the body 102 in a desired configuration. In one embodiment, the handle and/or other element 130 may be integrated with the body 102 (e.g., may be depressions and/or protrusions of the body 102 that support gripping or other holding or manipulation by a user). A user manipulatable element 140 (e.g., a trigger, button, switch, etc.) may be connected with and/or positioned adjacent to a portion of the handle and/or other element 130 for activating certain components, elements, or features of the audio projection device, such as lighting, or amplification circuitry or elements, as discussed in greater detail herein. In an alternative embodiment, the user manipulatable element 140 may be positioned in alternative locations, such as elsewhere on the body 102 and/or on or near ends (104, 106).

At the second end 106 of the audio projection device 100, one or more illuminating elements 110 (e.g., lights, LEDs, light strips, etc.) may be provided or disposed along all or a portion of the second end 106 (e.g., in a ring disposed around all or some of the diameter of the second end 106). For example, a strip of LEDs may be coupled along all or a portion of the diameter of the second end 106 and configured to light up in response to a user manipulating the user manipulatable element 140. In an alternative embodiment, different positioning for one or more lights may be used, such as providing one or more lights at a different location at or along the body 102, for example, as discussed in other exemplary embodiments. Different configurations for lighting up the illuminating elements 110 may be possible based upon the user manipulations with the user manipulatable element 140. For example, only one configuration of illumination may be possible: upon manipulating the user manipulatable element 140, the one or more illuminating elements 110 may switch between an ON state or an OFF state.

In another example, multiple configurations of illumination may be possible: upon manipulating the user manipulatable element 140 for a first time, the one or more illuminating elements 110 may switch to a first configuration (e.g., ON); upon manipulating the user manipulatable element 140 for a second time, the one or more illuminating elements 110 may switch to a second configuration (e.g., strobing); upon manipulating the user manipulatable element 140 for a third time, the one or more illuminating elements 110 may switch to a third configuration (e.g., sequential illumination of lighting elements, such that the lights appear to move in a ring or some other pattern, such as around the second end 106); upon manipulating the user manipulatable element 140 for a fourth time, the one or more illuminating elements 110 may switch to a fourth configuration (e.g., OFF). Greater or fewer configurations that operate in a similar or different manner (e.g., particular patterns, particular colors, etc.), and/or in a different order (e.g., sequential lighting up of elements in a first direction, sequential lighting up of lights in a second direction, scrolling text or numbers or other graphics made up off illuminated lights, etc.) may be possible in alternative embodiments. In still other embodiments, more than one user manipulatable element 140 and/or additional user-manipulatable elements (e.g., additional buttons, switches, keypads, etc.) may be used (e.g., a different element for each possible configuration of the one or more illuminating elements 110).

As discussed above, in one embodiment, lighting or other illuminating elements may be integrated with or otherwise accepted at the first end 104, the second end 106, and/or otherwise at or along some portion of the body 102. The disclosures above concerning the illuminating elements 110 may be equally applicable to the first end 104, the second end, and/or at or along the body 102, in addition to or in replacement of the second end 106 of the body 102. Likewise, although a cap or other component, configuration, or end 112 have been exemplary described as relating to the first end 104 of the body 106, a similar cap or other component, configuration, or end may be equally applicable to the second end 106 in addition to or in replacement of the first end 104 of the body 102 and/or some other replaceable component may be used for other portions of the body 102. In one embodiment lighting or other illuminating elements may be configured to move and/or make noise due to their movement within or within the audio projection device 100.

As discussed above, all or a portion of the body 102 (or some component that is connected with the body 102) of the audio projection device 100 may be configured to contain one or more audible elements (120, 122) within. For example, the body 102 may be formed or manufactured to have a cavity capable of placing the one or more audible elements (120, 122) within such that the one or more audible elements (120, 122) may move (e.g., substantially freely) within and make contact with one another and/or with the boundaries of the cavity. Such one or more audible elements (120, 122) may thus make noise (e.g., a rattling noise) when the one or more audible elements (120, 122) make such contact. The one or more audible elements (120, 122) may be disposed into the cavity via access to the cavity by disconnecting and/or reconnecting one or both of the ends (104, 106) of the audio projection device 100. Thus, the audio projection device 100 may be configured to be shaken or otherwise moved about by a user to additionally make audible noise via the movement of the one or more audible elements (120, 122). In certain embodiments, the one or more audible elements may be rigid or substantially rigid elements (e.g., spheres, balls, etc. made of a hard plastic). Multiple different types or configurations of audible elements may be used in certain embodiments (e.g., different colors, shapes, materials, etc.) or only one type of configuration of audible elements may be used, as desired.

In certain embodiments, all or a portion of the body 102 may be manufactured of a transparent, translucent, or semi-transparent or translucent material and configured to allow the one or more audible elements (120, 122) to be visible through the body 102 or some portion of the body 102. Thus, in addition to making noise due to their movement, viewers of the body 102 may also witness the movement of the one or more audible elements (120, 122) within the body 102. In certain embodiments, the one or more audible elements (120, 122) may not be audible (e.g., may be made of a material that is soft, such as foam, rubber, etc.) such that their movement within the cavity of the audio projection device 100 may be viewed, but substantially no sound can be heard.

Although FIG. 1 illustrates an audio projection device 100 having various features (e.g., both one or more illuminating elements 110 and one or more audible elements (120, 122)), an alternative embodiment may include fewer features (e.g., only one or more illuminating elements 110 and/or only one or more audible elements (120, 122)), different features, or greater number of features. In certain embodiments, beads or other packaged elements may be sold and/or otherwise configured to be accepted within all or a portion of the body 102 as discussed above (e.g., a user may purchase or provide elements with particular colors and/or characteristics, such as colors relating to the colors of a particular sports team) to customize the audio projection device 100 to correspond to the particular sports team or event for which the audio projection device 100 is to be used.

Figure 2B:
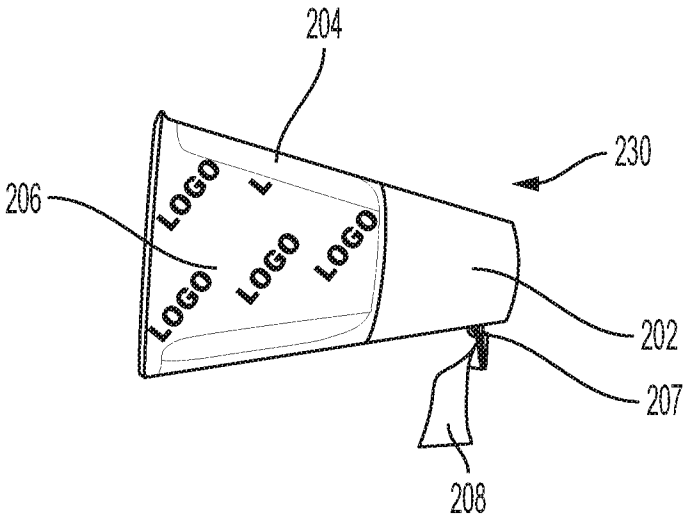
FIG. 2B illustrates a side view of the exemplary audio projection device of FIG. 2A and also having additional graphic features, according to one embodiment of the present invention.
Figure 2C:
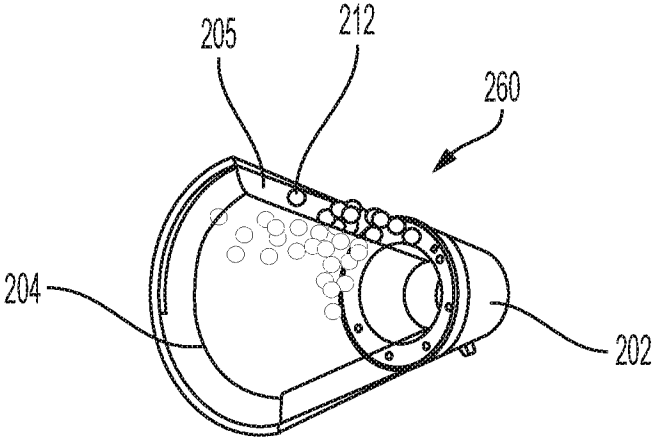
FIG. 2C illustrates a cut-away perspective view of the exemplary audio projection device of FIG. 2A and also having additional audible features, according to one embodiment of the present invention.
Figure 2A:
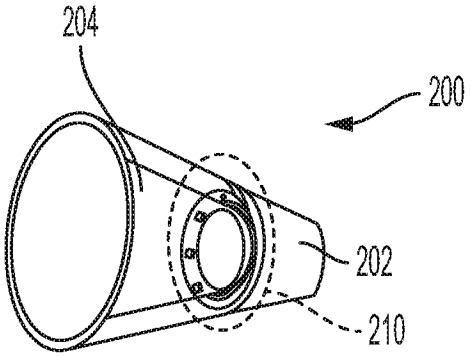
FIG. 2A illustrates a perspective view of an exemplary audio projection device having additional illumination, according to one embodiment of the present invention.

FIG. 2A illustrates a perspective view 200 of an exemplary audio projection device having additional illumination capabilities. The audio projection device may include features that are the same as or similar to those discussed throughout. The audio projection device may include a base component 202 that is connected (e.g., screwed together with, adhered, clipped, or otherwise connected and/or removably connected) with projection component 204. The base component 202 may include elements or components (e.g., active and/or passive) configured to receive sound or audio signals and propagate such sound or audio signals out of the projection component 204, for example to increase the volume of the sound or audio signals and/or transmit the sound or audio signals a greater distance or in a focused direction or orientation.

In addition to this audio projection capability, the audio projection device may also include one or more lighting elements 210. The lighting elements may be any of a variety of possible components, such as LED's, lamps, or reflective material, display screens, etc. The one or more lighting elements 210 may be configured to illuminate in a variety of patterns (e.g., strobing, chasing, etc.). In certain embodiments, the projection component 204 may be manufactured out of a material or construction in such a fashion so as to aid in displaying the illumination from the one or more lighting elements 210 to viewers. For example, the projection component 204 may be at least partially constructed of a translucent or transparent material and/or shaped such that illumination from the one or more lighting elements 210 is desirably displayed along some portion of the projection component 204. In one embodiment, other elements or materials (e.g., reflective) may be disposed along all or some of the projection component to aid in the display of the one or more lighting elements 210. As illustrated in the perspective view 200 of FIG. 2A, the one or more lighting elements 210 may be disposed in a ring at a connection between the base 202 and the projection component 204. In an alternative embodiment, any of a variety of possible shapes and/or configurations for the one or more lighting elements 210 may be used.

FIG. 2B illustrates a side view 230 of the audio projection device of FIG. 2A and also having additional graphic features. As shown, the projection component 204 may include an interior component 206 that fits at least partially within or interior to an outside perimeter of a material making up the projection component 204. This interior component 206 may be further shaped to aid in the projection of audio and/or to display illumination from the one or more lighting elements 210. The interior component 206 may contain graphical images disposed thereon. The interior component 206 may be conveniently swappable or replaceable, allowing for a user of the audio projection device to customize the audio projection device depending upon a desired use. For example, the audio projection device may allow for a user to conveniently swap graphical logos or images from one sports team or sponsor to another, depending on the venue or entertainment activity the audio projection device is being used for. In certain embodiments, the interior component 206 may be removeable and graphical images or inserts (e.g., skins) replaced in the same interior component 206 such that the same interior component 206 may then be inserted back into the audio projection device, but with alternative graphics. A handle, lanyard, wrist-strap, or other component 208 for user grasping or manipulation may be connected with the base component 202 of the audio projection device via a connector 207. The connector 207 may be any of a variety of possible connectors, including clamps, clips, etc. and/or may be connected with any portion of the audio projection device in alternative embodiments. In an alternative embodiment, the connector 207 and/or the component 208 may be integrated with the base component 202 or other portion of the audio projection device via depressions and/or protrusions of the surface making up such base component 202 or other portion of the audio projection device.

FIG. 2C illustrates a cut-away perspective view 260 of the exemplary audio projection device of FIG. 2A and also having additional audible features. As shown, one or more audible elements 212 may be configured to be disposed within a portion or cavity of the audio projection device, such as within some portion of the projection component 204. For example, the projection component 204 may contain a space 205 positioned between an outer material and an inner material that can selectively receive, for example, via opening of a panel, door, or other element that allows access to the space 205, the one or more audible elements 212 therein. In one embodiment, the space 205 may be accessed when the projection component 204 is disconnected from the base component 202, but is not accessible when the projection component 204 is connected with the base component 202. In this fashion, when the projection component 204 and the base component 202 are connected together, the one or more audible elements 212 may be securely maintained within the space 205 of the projection component 204 and less likely to fall out of the audio projection device.

In still another embodiment, the space 205 may be accessed by sliding the outer material and the inner material with respect to one another to reveal an opening to the space 205 for insertion and/or removal of the one or more audible elements 212. In still another embodiment, the space 205 may be accessed through connection and/or disconnection of the interior component 206 with the remainder of the projection component 204 and/or audio projection device. In still another embodiment, the one or more audible elements 212 may be contained within a different portion of the audio projection device (e.g., within the base component 204 or a different portion of the projection component 204). Any of a variety of possible means may be used for the insertion or removal of the one or more audible elements 212 in the audio projection device. In an alternative embodiment, the one or more audible elements 212 may be configured to overlay a portion of the audio projection device (e.g., a component may be configured to engage with and/or wrap around at least a portion of the audio projection device whereby the one or more audible elements 212 may move between an outer surface of the audio projection device and the component that is engaging with and/or wrapping around at least a portion of the audio projection device).

The audible elements 212 may include a plurality of different audible elements (e.g., beads or elements having different shapes, materials, aesthetics, etc.). For example, one audible element 212 may be rigid or substantially rigid in material and/or in the form of a substantially spherical shape with a particular color, graphic, or texture. The one or more audible elements 212 may contain openings, cuts, grooves, slots, depressions, protrusions, etc., for example, to aid in the one or more audible elements 212 in moving in a desired fashion and/or to make a particular sound when the one or more audible elements 212 make contact with each other (e.g., same or different type audible elements) and/or other materials associated with the audio projection device.

The one or more audible elements 212 may be the same as one another and/or different from one another (e.g., different shapes, different sizes, different colors, different surface textures, different openings therein, etc.). In one embodiment, the one or more audible elements 212 may be beads and/or have a maximum diameter of 0.375 inches or 9.5 mm. In one embodiment, the one or more audible elements 212 may be manufactured of one or more of opaque, translucent, and/r transparent materials. In some embodiments, one or more of the audible elements (310, 320) may partially or fully illuminate (e.g., include lights, lamps or LEDs within or connected with the one or more of the audible elements). In one embodiment, the one or more audible elements 212 may be programmable (e.g., to have a particular color, flashing pattern, etc.) The one or more audible elements 212 may be made of any of a variety of materials (e.g., plastic, metal, etc.) in order to achieve a desired sound, weight, movement, etc. For example, the one or more audible elements may be made and/or coated and/or impregnated with a material that is configured to glow in the dark and/or exhibit particular illumination properties when exposed to particular lighting, such as black lights. If the one or more audible elements 212 are visible when within the audio projection device, for example, as previously discussed, witnessing the one or more audible elements 212 movement within the audio projection device may provide additional excitement to such witnesses during use. In certain embodiments, the one or more audible elements 212 may not be audible (e.g., may be made of materials and/or configured to move within the audio projection device in such a way as to not make audible noises), but may provide entertainment to viewers of the audio projection device based upon their movement and/or visual properties.

Figure 3:
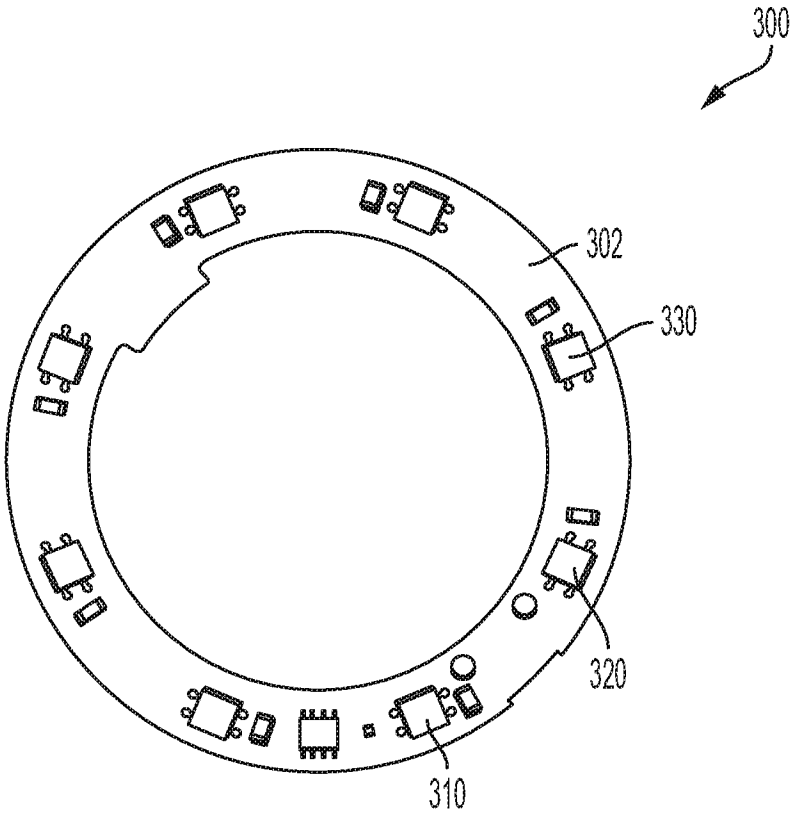
FIG. 3 illustrates a front view of an exemplary illumination feature for an audio projection device, according to one embodiment of the present invention.

FIG. 3 illustrates an exemplary illumination feature 300 for an audio projection device, according to one embodiment of the present invention. The illumination feature 200 and/or the audio projection device may be the same as or similar to those discussed throughout. For example, the illumination feature 300 may be configured to be disposed or around all or a portion of the audio projection device, such as the audio projection device 100 of FIG. 1 and/or the audio projection devices of FIGS. 2A-C. The illumination feature 300 may be a material or strip 302 that includes a plurality of illuminating components (310, 320, 330) connected therewith or thereon. The plurality of illuminating components (310, 320, 330) may be lights (e.g., LEDs) that have same configurations or characteristics or different configurations or characteristics (e.g., shapes, colors, etc.).

The plurality of illuminating components (310, 320, 330) may be independently operatable (e.g., illuminating component 310 may be ON while illuminating component 320 or illuminating component 330 are OFF) and/or may be configured to operate as a group independent of other illuminating components along the material or strip 302 (e.g., all of the illuminating components (310, 320, 330) turn ON or OFF together, but may be ON while other illuminating components along the material or strip 302 are OFF) and/or may be configured to operate as a group with other illuminating components along the material or strip 302 (e.g., all lights on the material or strip 302 turn ON or OFF together). The same or similar to previous discussions, control or operation of the one or more illuminating components (310, 320, 330) may be in response to user input, such as one or more user manipulatable element(s) associated with the audio projection device. In another embodiment, the one or more illuminating components (310, 320, 330) may be in response to other stimuli, different from the user who is holding or controlling the audio projection device (e.g., may be pre-programmed for a particular operation), such as in response to other devices such as other audio projection devices. Such response may be in the form of wired or wireless communication, such as Bluetooth, Wi-Fi, or other radio signals.

Figure 4B:
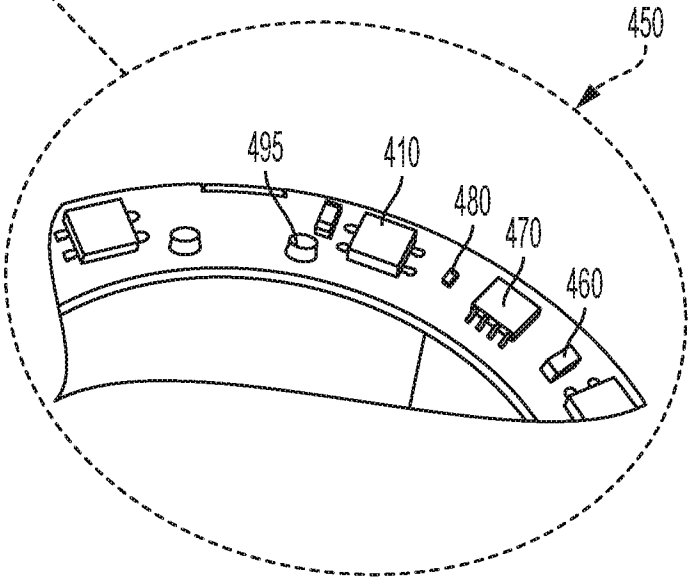
FIG. 4B illustrates a zoomed-in portion of the exemplary illumination feature of FIG. 4A, according to one embodiment of the present invention.
Figure 4A:
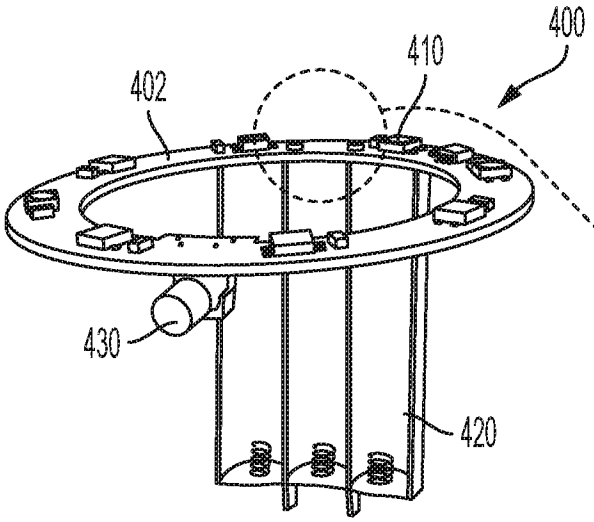
FIG. 4A illustrates a perspective view of an exemplary illumination feature for an audio projection device, according to one embodiment of the present invention.

FIG. 4A illustrates a perspective view 400 of exemplary illumination feature for an audio projection device, according to one embodiment of the present invention. FIG. 4B illustrates a zoomed-in portion of the exemplary illumination feature of FIG. 4A. The illumination feature and/or the audio projection device may be the same as or similar to those discussed throughout. With reference to FIGS. 4A-B, the illumination feature includes a material 402 (e.g., a printed circuit board) and incorporate at least one illuminating element 410. The material 402 (e.g., printed circuit board) may be 0.06 inches or 1.5 mm thick, single or multi-layer and configured to support and/or provide conductive or electrical connection between components mounted or connected thereto. As previously discussed, the material 402 may be configured to connect with and/or fit within a portion of an audio projection device for providing additional illumination features to the audio projection device via one or more lights connected with the material 402.

The material 402 may take the form of any of a variety of possible shapes. In one embodiment, as shown, the material 402 may be shaped in the form of a ring with an outer radius and an inner radius. The material 402 may also incorporate a number of associated components (460, 470, 480), discussed in greater detail herein. In an alternative embodiment, the material 410 may not be a printed circuit board, but may connect with a separate circuit board or other electrical interconnection of components. In still another embodiment, no separate material 402 may be needed and the one or more illumination elements 410 may be connected directly with a portion of the structure of audio projection device (e.g., a base of an audio projection device, such as base 202 of FIG. 2A).

A processor (e.g., a microprocessor) 470 or other controller or electronic device for controlling operation of the at least one illuminating element 410 may be in electrical connection with one or more of capacitor(s) 460, resistor(s) 480, and/or the at least one illuminating element 410 as desired to support operation of the at least one illuminating element 410. In certain embodiments, a single processor 470 may be used for controlling all of the at least one illuminating elements 410 connected with the material 402. The processor 470 may be configured to control the at least one illuminating elements 410 in accordance with a pre-programmed pattern or other sequence or timing for illumination of certain of the at least one illuminating elements 410. For example, one or more patterns for illumination of the at least one illuminating elements 410 may be stored (e.g., in a memory incorporated with the processor 470 or otherwise connected or in communication with the processor 470). Particular patterns desired may be selected by a user for the processor 470 to use in controlling the at least one illuminating elements 410. Additional patterns for illumination may be downloaded or otherwise received for execution by the processor 470 (e.g., wirelessly or by wired connection via a communication device such as a hardware port (proprietary or non-proprietary), wireless receiver, etc. In an alternative embodiment, multiple processors 470 and/or other control electronics may be used.

The at least one illuminating element 410 and/or one or more of the associated components (460, 470, 480) may require power in order to operate. A power source 420 is connected 495 with the material 402. The connection 495 between the power source 420 and the material 402 may be by adhesive, clips, holding tabs, screws, or any other fastener configured to maintain the power source and the material 402 together in a desired configuration or orientation. In one embodiment, the power source 420 may be a battery bay. The battery bay may be configured to accept one or more batteries (e.g., rechargeable or non-rechargeable) in order to supply power to the at least one illuminating element 410 and/or the one or more of the associated components (460, 470, 480). In an alternative embodiment, different power sources may be used (e.g., solar, wireless, etc.) and/or the at least one illuminating element 410 and/or certain of the one or more of the associated components (460, 470, 480) may have their own individual sources of power. In one embodiment, the power source 420 may be configured to be accepted within a base (e.g., base 202 of FIG. 2A) of an audio projection device when assembled.

In one embodiment, the power source 420 may be configured to recharge, for example, via a Universal Serial Bus ("USB") port, or other port or connection of the audio projection device. For example, the audio projection device may be configured to connect (e.g., wired via a port or wirelessly) to connect with and/or receive and/or provide power from/to a cellular phone or other electronic device. Such other port or connection may allow for transfer of other data to and/or from the audio projection device, such as downloading or transferring of new patterns for lighting, new colors or color combinations, etc. Such options may be made available via download (e.g., paid or free) from a webpage that a user can browse and download and cause to be transferred to their audio projection device.

A manipulatable element 430 may be configured to be manipulated by a user in order to provide power from the power source 420 to the at least one illuminating element 410 and/or one or more of the associated components (460, 470, 480) and/or to control operation of the at least one illuminating element 410 and/or one or more of the associated components (460, 470, 480). For example, the manipulatable element 430 may be a button or switch that can be interfaced with by a user. Upon clicking or otherwise interfacing with the manipulatable element 430, particular operation may be obtained that results in a particular operation or pattern for illumination of the at least one illuminating element 410. Possible modes of operation of the at least one illuminating element 410 based upon interaction with the manipulatable element 430 may include: (i) turning all or some of the at least one illuminating element 410 ON, (ii) turning all or some of the at least one illuminating element 410 OFF, and/or (iii) turning certain of the at least one illuminating element 410 ON and OFF in a particular pattern (e.g., a wave pattern, circular chase pattern, strobe pattern, etc.).

Figure 5B:
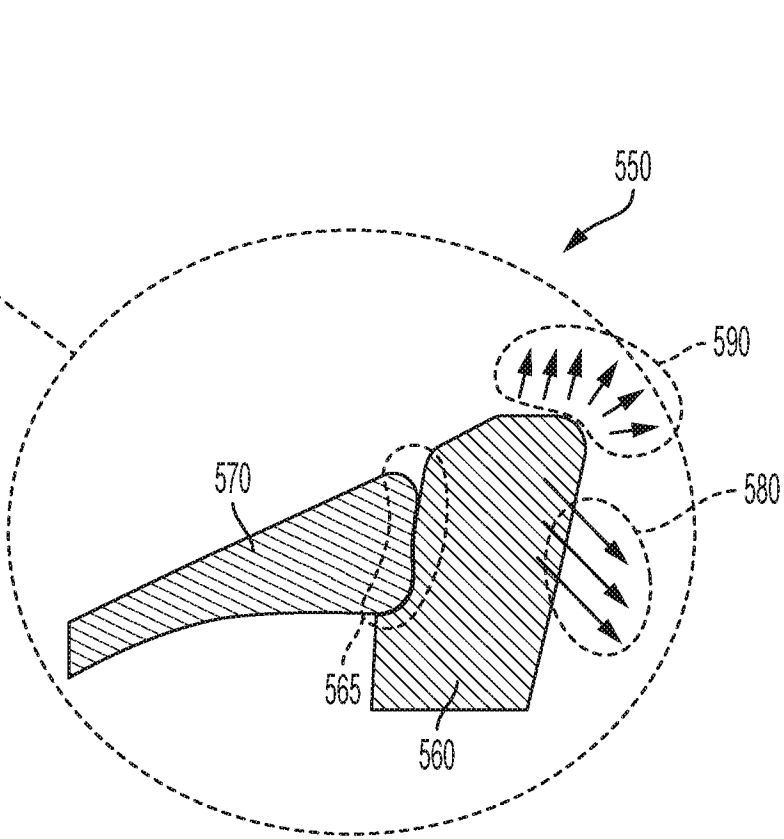
FIG. 5B illustrates a zoomed-in portion of the exemplary audio projection device of FIG. 5A, according to one embodiment of the present invention.
Figure 5A:
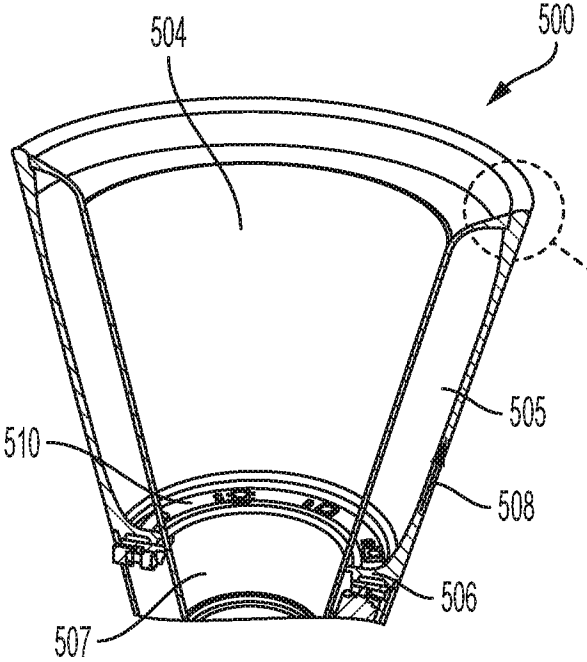
FIG. 5A illustrates a cut-away view of a portion of an exemplary audio projection device, according to one embodiment of the present invention.

FIG. 5A illustrates a cut-away view 500 of a portion of an audio projection device. The audio projection device may include features that are the same as or similar to those discussed throughout. For example, the portion of an audio projection device shown in FIG. 5A may include a projection section 504 that may be the same or similar to a projection component, such as projection component 204 shown in FIG. 2A. FIG. 5B illustrates a zoomed-in portion of the audio projection device shown in FIG. 5A.

The projection section 504 may be shaped as a cone. In an alternative embodiment, any of a variety of possible shapes may be used. The projection section 504 may be formed of two cones or other shapes, such as via an inner material 570 (e.g., formed as an inner cone) and an outer material 560 (e.g., formed as an outer cone). The inner material 570 and/or outer material 560 may be made of any of a variety of materials (e.g., plastics, etc.). In one embodiment, printing (e.g., paint, acrylics, etc.) may be made on the inner material 570 and/or outer material 560. In still another embodiment, words, logos, images, or other shapes may be formed as part of the inner material 570 and/or outer material 560, for example, for branding purposes. As discussed in greater detail herein, lighting may be directed through and/or over the inner material 570 and/or outer material 560, allowing for such words, logos, images, or other shapes to be illuminated. A space or cavity 505 is formed and/or disposed between the inner material 570 and the outer material 560. In one embodiment, where the inner material 570 forms a conical shape and the outer material 560 forms a conical shape, the space 505 may also be conical. Thus, as discussed throughout, elements, such as beads, may be inserted into the space 505. The elements may cause an audible sound to be emitted (e.g., rattling) in certain embodiments when the elements are caused to move around within the space 505. The elements may be caused to be held within the space 505 by a material 510, such as a printed circuit board, that forms one barrier of the space 505.

As shown in FIG. 5B, the inner material 570 and the outer material 560 may connect 565 together (e.g., snap-fit with one another). The connection 565 may incorporate a bump or other protrusion (e.g., 0.003 inches or 0.076 mm) in the inner material 570 that cooperates with a corresponding dip or other depression in the outer material 560. Such a protrusion/depression may aid in keeping the inner material 570 in contact with the outer material 560 when the audio projection device is otherwise being manipulated or some portion disassembled (e.g., when disconnecting a base of the audio projection device, replacing batteries of the audio projection device, etc.). The connection 565 may allow for a user to separate the inner material 570 from the outer material 560 by applying an amount of force and/or pressure to the inner material 570 and/or the outer material 560 to cause the connection 565 to disengage. In an alternative embodiment, other manners of connecting the inner material 570 to the outer material 560, for example, in order to provide a seal to the space 505 so that elements cannot undesirably exit from the space 505. Any of a variety of possible manners or connection or fastening may be used for the connection 565 in an alternative embodiment. In certain embodiments, the inner material 570 and/or the outer material 560 may be formed integrally with one another such that they are not intended to disconnect from one another (e.g., a single construction or mold that forms an interior shape, such as an interior cone, and an exterior shape, such as an exterior cone).

As discussed, the audio projection device may have illumination capabilities, such as by including LED's or other light sources upon or connected with the material 510. In one embodiment that employs an inner material 570 forming a shape and an outer material 560 forming a shape (e.g., an outer cone and an inner cone), light that is illuminated from such light sources may travel 508 through the outer material 560 and subsequently exit along an outer rim. Edges of the inner material 570 and/or outer material 560 may be configured to as to direct and/or refract light in particular manners. For example, the edge of the outer material 560 may be bevelled such that light is refracted at an angle, allowing for the light to be seen from the side exit 580 of the audio projection device and/or out of the end exit 590 of the outer material 560. The inner material 570 and/or outer material 560 may be configured so as to direct light in any desired location. For example, light may be directed via the inner material 570 and/or outer material 560 to pass behind or underneath 506 the material 510. Such a configuration may operate to illuminate other areas of the audio projection device, such as an interior compartment 507 of the audio projection device.

Figure 6B:
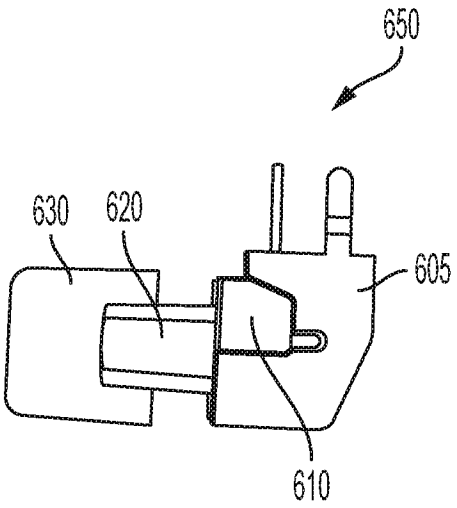
FIG. 6B illustrates a cut-away side view of the manipulatable element of FIG. 6A, according to one embodiment of the present invention.
Figure 6A:
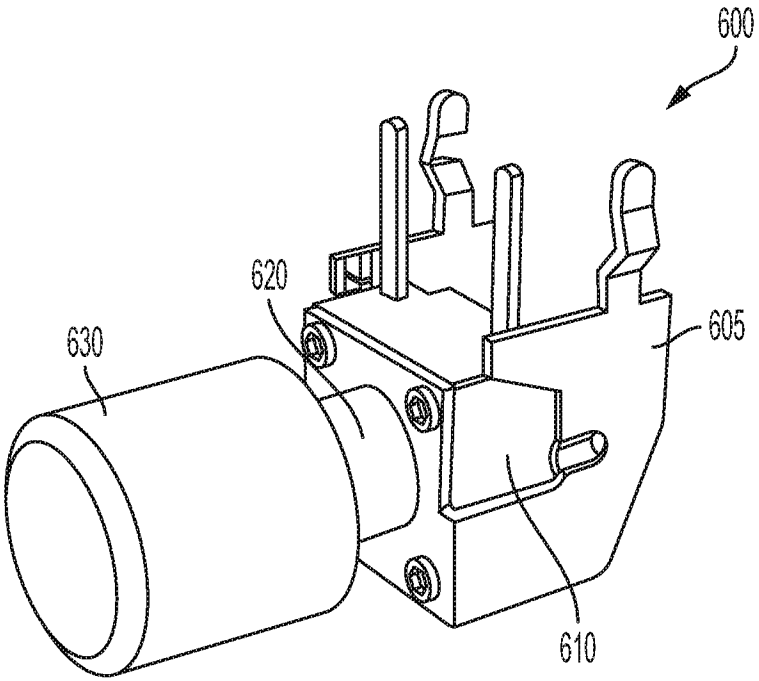
FIG. 6A illustrates a perspective view of a manipulatable element of an exemplary audio projection device, according to one embodiment of the present invention.

FIG. 6A illustrates a perspective view 600 of a manipulatable element of an exemplary audio projection device. FIG. 6B illustrates a cut-away side view 550 of the manipulatable element of FIG. 6A. The manipulatable element and/or the audio projection device may include features that are the same as or similar to those discussed throughout. The manipulatable element may be a switch, button, trigger or other component that allows a user to interact, interface, or otherwise manipulate in order to control some operation of the audio projection device (e.g., operation of one or more illumination elements). The manipulatable element may include a base portion 610 connected with a moveable element 620. A user may press or otherwise move or interact with the moveable element 620. A clamp 605 or other structure is connected with the base portion 610 for fastening the manipulatable element with some other portion or structure of the audio projection device. A cap 630 may cover all or a portion of the moveable element 620. The cap 630 may be configured to be physically in contact with a user when the user is manipulating the manipulatable element. The cap 630 may be configured to be removeable (e.g., to support customization by a user via replacement with other caps in desired colors, shapes, etc. and/or to allow for a user to replace the cap 630 should it be at an end of its useful life and/or otherwise desirably replaced).

Figure 7B:
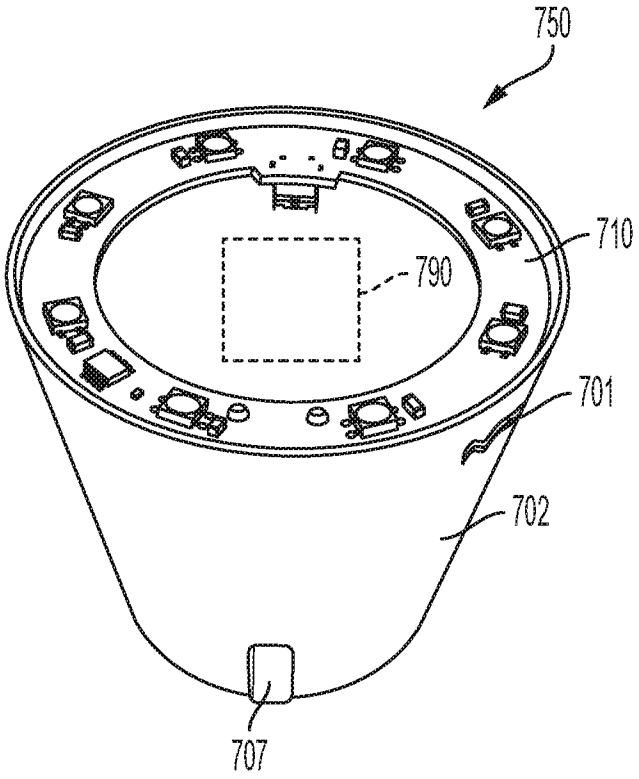
FIG. 7B illustrates a perspective view of the base portion of FIG. 7A and also including an exemplary illumination feature connected therewith, according to one embodiment of the present invention.
Figure 7A:
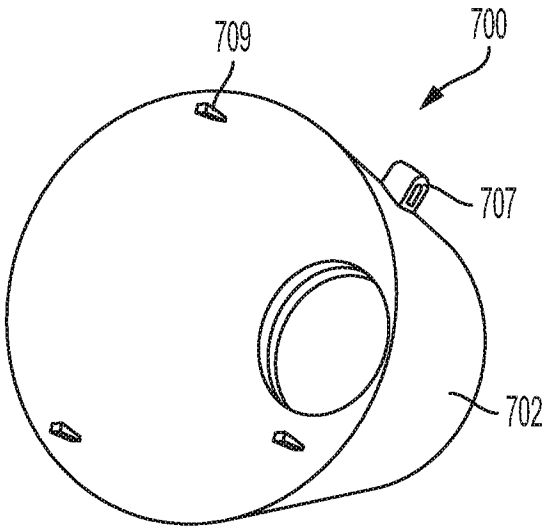
FIG. 7A illustrates a perspective view of a base portion of an exemplary audio projection device, according to one embodiment of the present invention.

FIG. 7A illustrates a perspective view 700 of a base portion 702 of an audio projection device. The base portion 702 and/or the audio projection device may include features that are the same as or similar to those discussed throughout. The base portion 702 may be made of a variety of possible materials, including plastic, metal, fiberglass, carbon fiber, etc. The base portion 702 may include a connection element 707 that allows for a user to connect other peripherals to the base portion 702 (e.g., wrist straps, lanyards, streamers, etc.). As discussed in greater detail throughout and as shown in FIG. 7B that illustrates a perspective view 750 of the base portion 702, the base portion 702 may be configured to connect with other elements, such as printed circuit boards for providing additional illumination features to an audio projection device. The base portion 702 may include connection points 709 that are configured to engage or otherwise contact (e.g., be adhered with) a printed circuit board 710 and/or other component intended to mate or make contact with the base portion 702. An interior label 790 (e.g., warning, instructions, etc.) may be printed or otherwise affixed with an interior surface of the base portion 702. Likewise, an exterior label 701 (e.g., branding, graphics, logos, etc.) may be printed or otherwise affixed with an exterior surface of the base portion 702.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description.

Although embodiments of audio projection devices illustrated throughout showcase various features and/or combinations of features (e.g., moveable elements, illuminating elements, etc.), alternative embodiments may include greater, fewer, and/or different features. For example, in one embodiment, an audio projection device may not be configured to be disassembled by a user, may not have illumination capabilities, etc. In such an embodiment, customization of the audio projection device may be more limited and/or the audio projection device may have more limited functionality (e.g., does not allow for insertion/removal of elements, such as beads, within some portion of the audio projection device). This may help keep costs down (e.g., to allow for more disposable audio projection devices), but at reduced device capability.

In another exemplary embodiment, in replacement of or in addition to illumination components on a printed circuit board, an audio projection device may include displays, screens, pixel banners, etc. that allow for logos, images, words, etc. appear and/or scroll across some portion of the audio projection device (e.g., across an outer or inner material, such as a cone). For example, the audio projection device may be configured to communicate (e.g., via wireless communication such as Bluetooth, Wi-Fi, or other radio signals) for the streaming, scrolling, and/or display of such content upon a display, like photographs, video, text, numbers, graphics, logos, etc. In some embodiments, the display may be similar to teletype messages whereby the content is scrolled or otherwise animated across one or more displays. In certain embodiments, such displays, screens, pixel banners, etc. may take the place of outer or inner materials and/or form or be disposed around an outer perimeter of a portion of an audio projection device.

All changes that come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternative order from those provided in the examples.

The invention claimed is:

1. An audio projection device, comprising:

a first body having a first opening at a first end and a second opening at a second end, the first body is shaped as a cone and the second opening is larger than the first opening, the first body defining a hollow wall having an inner surface and an outer surface separated by a cavity;

a second body removably coupled to the first body, when the second body is removed from the first body, the cavity of the first body is accessible, and when the second body is coupled to the first body, the cavity of the first body is closed; and one or more audible elements configured to fit within the cavity and movable in the cavity to contact the inner surface or the outer surface to make noise when the first body is moved.

2. The audio projection device of claim 1, further comprising at least one illuminating element positioned around an end of the second body, and dispose at a connection between the first body and the second body so that light from the lights projects into the cavity.

3. The audio projection device of claim 2, further comprising a manipulatable element to control a pattern of light emitted from the at least one illuminating element.

4. The audio projection device of claim 3, wherein the first body is removably coupled to the second body through a threaded interface for screwing the first body to the second body.

5. The audio projection device of claim 4, further comprising a processor in communication with the manipulatable element, the processor configured to control the at least one illuminating element.

6. The audio projection device of claim 5, wherein the first body is at least partially transparent or translucent.

* * * * *